US005371661A

United States Patent [19]

Simpson

[11] Patent Number: 5,371,661

[45] Date of Patent: Dec. 6, 1994

[54] RETRO-FIT LIGHTING FIXTURE AND METHOD OF RETRO-FITTING

[76] Inventor: Alexander L. Simpson, 35 Donaldson Road, Holland Landing, Ontario, Canada, L0G 1H0

[21] Appl. No.: 93,552

[22] Filed: Jul. 19, 1993

[30] Foreign Application Priority Data

Jul. 21, 1992 [CA] Canada ..... 2074314

[51] Int. Cl.[5] ..... F21S 3/00; F21V 19/02

[52] U.S. Cl. ..... 362/220; 362/219; 362/221; 362/225; 362/254

[58] Field of Search ..... 362/219, 221, 260, 429, 362/217, 220, 225, 238, 250, 254, 362, 382, 388

[56] References Cited

U.S. PATENT DOCUMENTS

| | | | |
|---|---|---|---|
| 1,911,646 | 5/1933 | Phillips | 362/220 |
| 2,291,491 | 7/1942 | Naysmith | 362/221 |
| 2,295,788 | 9/1942 | Hoeveler | 362/221 |
| 2,323,073 | 6/1943 | Netting | 362/225 |
| 2,408,471 | 10/1946 | Merrill | 439/235 |
| 2,408,783 | 10/1946 | Kloner | 362/219 |
| 2,483,165 | 9/1949 | Young | 362/217 |
| 2,595,487 | 5/1952 | Runge et al. | 362/221 |
| 2,873,828 | 2/1959 | Zitomer | 362/217 |
| 3,086,105 | 4/1963 | Nieder-Westermann | 362/219 |
| 3,268,717 | 8/1966 | Gaines | 362/404 |
| 4,092,562 | 5/1976 | Campbell | 315/189 |
| 4,725,931 | 2/1988 | Bowidon | 362/151 |
| 5,006,970 | 4/1991 | Mackiewicz | 362/217 |

FOREIGN PATENT DOCUMENTS

| | | | |
|---|---|---|---|
| 86483 | 1/1966 | France | 362/221 |

*Primary Examiner*—Ira S. Lazarus
*Assistant Examiner*—Alan B. Cariaso

[57] ABSTRACT

A lighting fixture retrofitting apparatus for retrofitting old technology lighting tube fixtures, with smaller high efficiency lighting tubes, and having a lamp socket housing attachable to the existing ballast cover plate of an existing lighting fixture, a lamp socket opening in the housing, a high efficiency electrical lamp socket supported on the housing, and, fastenings for attaching the housing to the ballast cover of the existing lighting fixture.

9 Claims, 5 Drawing Sheets

80
82
F2
84
80
84
86
F2
90
84
92
80
82
88
90
86
F2

82
50
92
100
96
82
88
98
80
20
34
F2

100
50
34
34

RETRO-FIT LIGHTING FIXTURE AND METHOD OF RETRO-FITTING

FIELD OF THE INVENTION

The invention relates to apparatus for the retrofitting of existing lighting fixtures with new high efficiency tubes, and to lighting fixtures retro-fitted with improved equipment, and to a method of retrofitting.

BACKGROUND OF THE INVENTION

Recent developments and improvements in relation to fluorescent lighting tubes and also improvements in the so-called "ballasts" utilised to power such tubes, have provided for dramatic savings in the power consumption of such tubes. In the past, such tubes were typically of a diameter of about 1 and ½ inches, and were either provided with a single connection pin at each end or two connection pins. The tubes were also provided in various lengths, such as two foot, three foot, four foot, five foot, six foot lengths and also eight foot lengths.

Tubes in different lengths have been provided, but the most common lengths in use are four foot tubes and eight foot tubes.

Another factor in the use of such tubes is that whereas tubes of four foot or less commonly are provided with two electrical connection pins at each end, longer tubes such as eight foot tubes are commonly provided (with some rare exceptions in high power tubes) with only a single pin at each end. As a result, the electrical lamp sockets into which shorter tubes are fitted, provide two electrical contacts, to contact the two pins at each end. On the other hand the electrical lamp sockets into which the eight foot tubes are connected are provided with only a single contact at each end to contact the single pin.

New improved technology tubes having a reduced power consumption are presently available economically as two, three, and four foot tubes, having two pins at each end. Eight foot high efficiency tubes are now becoming available, but are not economical. They require two men for installation, and a costly new ballast. In the case of many office and commercial institutions, it is a relatively simple matter to simply remove the existing shorter tubes and replace them with the improved technology tubes assuming they are the same length. However, in the case of many industrial and commercial applications, longer tubes, particularly eight foot tubes are the standard. As yet, the new technology tubes have not been economically available in excess of four feet, and have not been provided in the "single pin" configuration.

In addition new higher efficiency ballasts are available which further reduce power consumption.

As a result, as at the present time, it is not possible to use the new high technology low-power consumption shorter tubes in other than existing fixtures of the same lengths.

Clearly, it is highly desirable to provide a system whereby the new high technology shorter tubes (i.e. four feet or less), and also the new high technology low power consumption ballasts, can be used in commercial and industrial situations, which are presently using longer old technology tubes of five feet or more. Obviously, this could readily be done by simply discarding the longer, i.e. eight foot tube lighting fixtures, and replacing them with twice the number of four foot tube, lighting fixtures.

However, the cost of doing this would be very substantial. The savings in power consumption would be offset by the very considerable increase in capital costs. Consequently, this simple obvious solution has not proved attractive.

Another solution is to remove the existing ballast cover plate and replace it with a new one, having openings to receive the high technology lighting receptacles. This is however a substantial expense, and requires specially designed new ballast cover plates to match various different makes of electrical fixtures. In some designs the ballast cover plate is not removeable, but is part of the box. In this case the whole fixture would have to be replaced.

Preferably, it would be desirable to provide a retrofitting apparatus which can be attached directly to the ballast cover plate of the old technology longer tube lighting fixture, adapting it to a receive two, or four or more, high technology tubes, in place of the single or multi old technology tubes presently in use, and also which permits a simple system for replacing the old ballast with the new high technology ballast.

BRIEF SUMMARY OF THE INVENTION

The invention therefore seeks to provide a lighting fixture retrofitting apparatus for retrofitting old technology tube lighting fixtures, of the type having ballasts and ballast cover plates with high technology lighting tubes, and comprising two way lamp socket housing means, lamp socket opening means in said two way housing means, at least two electrical lamp socket means supported on said two way housing means, and adapted to face in opposite directions, and, means for attaching said two way housing means to the ballast cover plate or an existing old technology fixture.

The invention further comprises such a lighting fixture retrofitting apparatus and including one-way lamp socket housing means adapted to be located at at least one end of a said lighting fixture, and comprising a generally rectangular box like configuration, and lamp socket opening means therein, and at least one electrical lamp socket extending through said lamp socket opening means, and fastening means for securing said one way housing means to the ballast cover plate of said existing electrical fixture.

The invention further comprises such a lighting fixture retrofitting apparatus and wherein said two way lamp socket housing means comprises a generally planar plate member, and two side walls formed at an angle thereto, and two end walls formed at an angle thereto, defining a generally rectangular hollow housing shape in plan, and including attachment flange means on at least one of said end walls or said side walls, attachment opening means formed in said attachment flange means, and bolt-openings formed in said plate member, adjacent said lamp socket opening means therein, for securing said electrical lamp sockets therein.

The invention further comprises such a lighting fixture retrofitting apparatus and wherein said one-way housing means comprises a generally planar plate member, and side walls formed at an angle thereto, and end walls formed at an angled thereto, and at least one attachment flange means extending from at least one of said side walls and said end walls, attachment opening means formed in said flange means, and bolt opening means formed in said planar member adjacent said lamp socket opening means, for securing at least one lamp socket therein.

The invention further comprises an electrical lighting fixture and comprising a generally rectangular box shaped member formed of sheet metal, ballast means within said box member connected to a source of electrical power, said rectangular box shaped structure defining a generally planar ballast cover plate, lamp socket housing means at each end of said ballast cover plate, and lamp socket housing means located part-way between said ends of said ballast cover plate and, electrical lamp sockets mounted on said lamp socket housing means, and oriented to receive at least two electrical lighting tubes, arranged end to end, said lighting tubes extending from said ends of said face plate, to said housing means part-way between said ends, whereby said electrical lighting fixture thereby supports said at least two lighting tubes thereon in end to end configuration.

The invention further comprises such an electrical lighting fixture and wherein said housing means comprise generally rectangular box-like structures secured to said ballast cover plate.

The invention further comprises such an electrical lighting fixture and including opening means defined by said ballast cover plate, and electrical connection means which extend from a ballast within said fixture, through said opening means in said ballast cover plate, to said lamp sockets mounted on said lamp socket housing means.

The invention further comprises a plurality of said electrical lighting fixtures, mounted in end-to-end abutting relation, and including two way lamp socket housing means extending between two adjacent said lighting fixtures, mounted on their respective ballast cover plates and electrical lamp sockets for receiving said tubes mounted on said two way housing means, mounted in back-to-back relation.

The invention further comprises such an electrical fixture, and including one way housing means at at least one end of at least one said electrical fixture, and at least one electrical lamp socket supported on said one way housing means.

The invention further comprises a method of retrofitting an existing electrical lighting fixture, having ballasts and ballast cover plates said lighting fixture defining two ends, and electrical lamp sockets mounted at said two ends for receiving at least one lighting tube extending therebetween, and comprising the steps of removing said existing electrical lamp sockets from either end of said lighting fixture, securing lamp socket housing means at each end of said ballast cover plate of said existing electrical fixture, securing further lamp socket housing means to said existing ballast coverplate intermediate said two ends of said lighting fixture, said housing means supporting electrical lamp sockets for receiving tubes therebetween, connecting said electrical lamp sockets to a source of electrical power, and, including the steps of mounting at least one electrical lighting tube between said housing means at one said end and said further lamp socket housing means, and mounting at least one further lighting tube between said housing means at said other end and said further lamp socket housing means, whereby said lighting tubes are mounted on said electrical fixture in end-to-end relation.

The invention further comprises such a method and wherein said electrical lighting fixture includes ballast means in said box member, and including the step of removing said ballast cover plate from said box member, removing said ballast means, and replacing the same with further ballast means, and connecting said further ballast means to said electrical lamp sockets on said housing means through openings in said ballast cover plate.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 6:
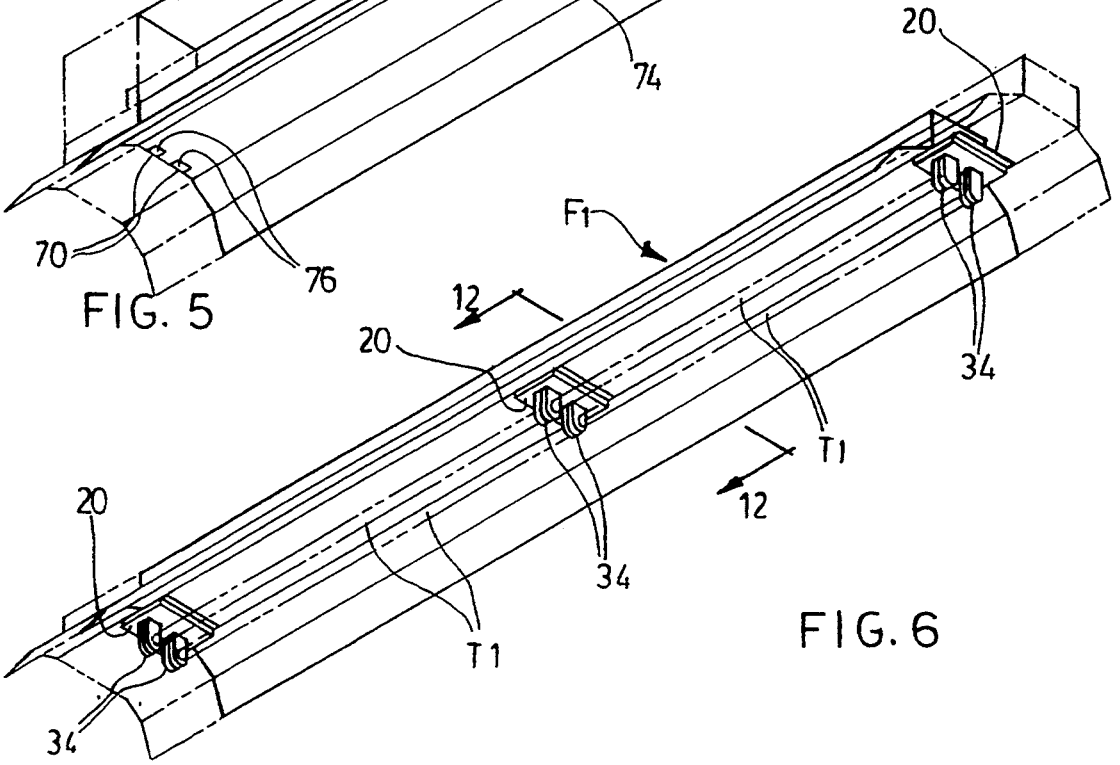
FIG. 6 is a perspective illustration, showing a third stage in the retrofit operation.
Figures 11, 11A, 11B:
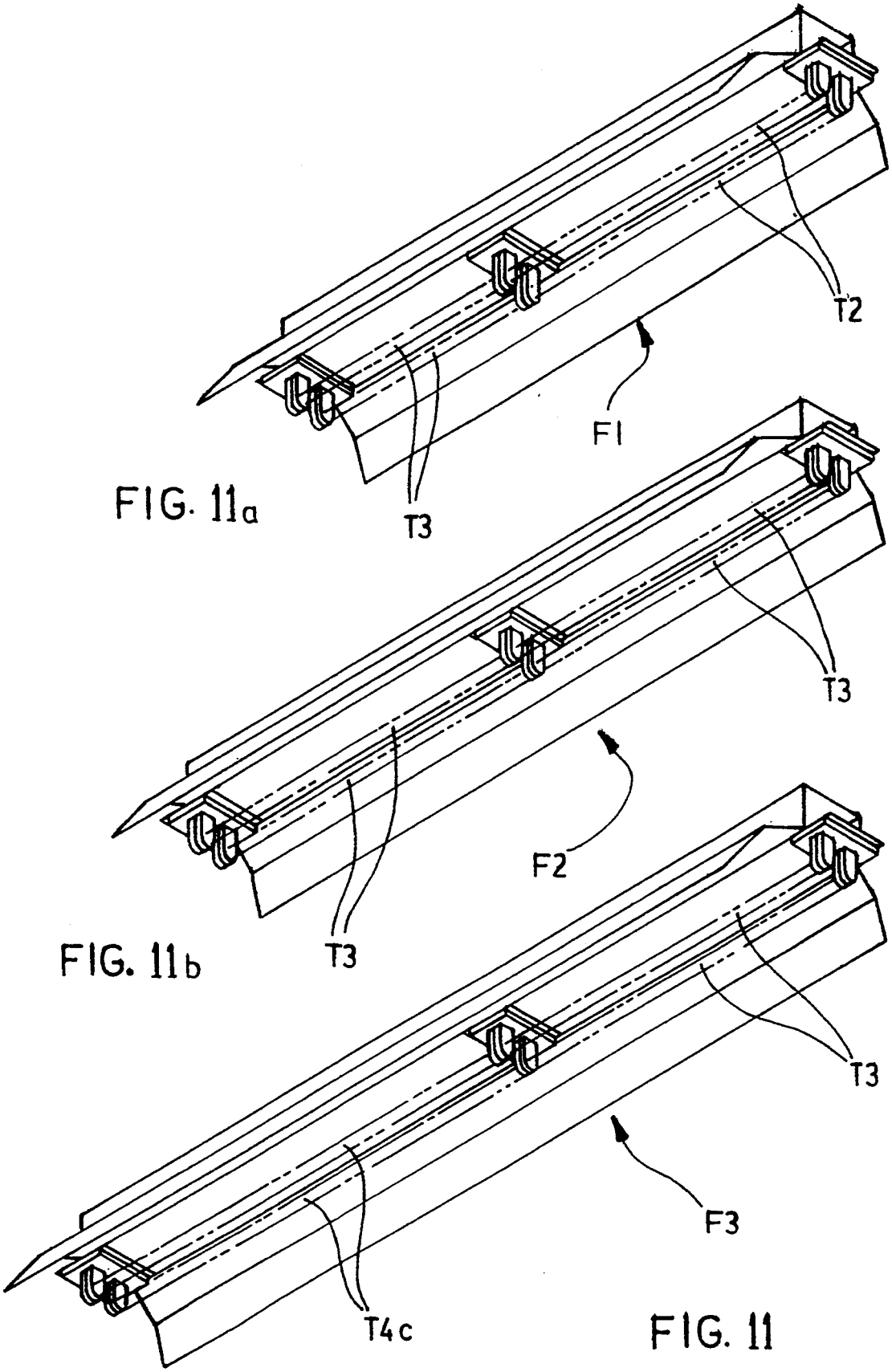
Figure 12:
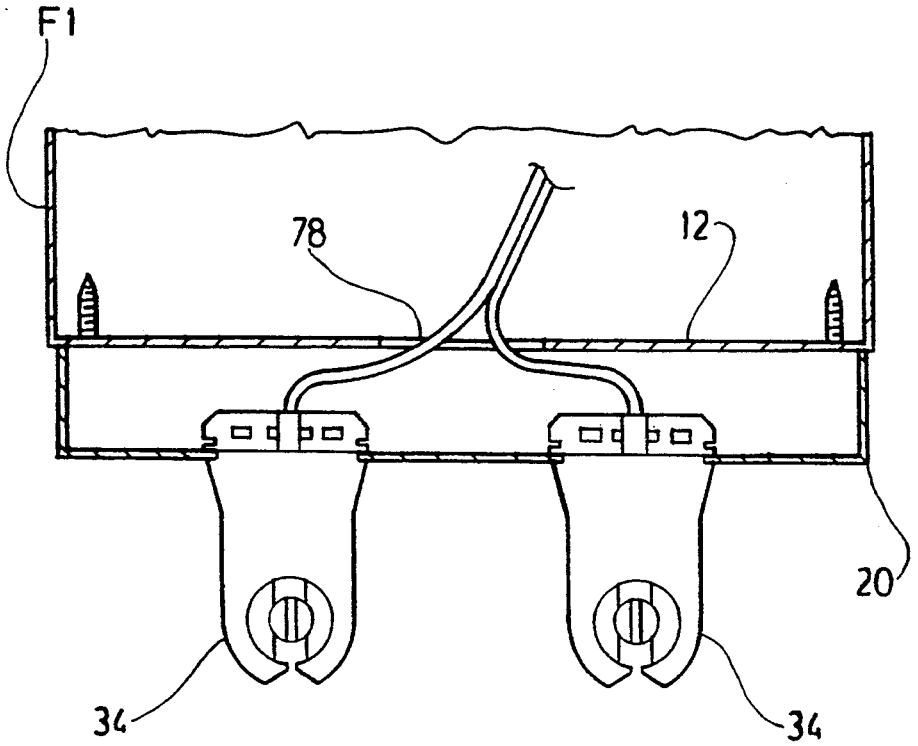

FIGS. 11A, 11B, and 11C show in lower plan view different configurations of retrofitting for different lengths of old style fixture, using various lengths of new high technology tubes, and, FIG. 12 is a section along the line 12—12 of FIG. 6.

DESCRIPTION OF A SPECIFIC EMBODIMENT

Figure 1:
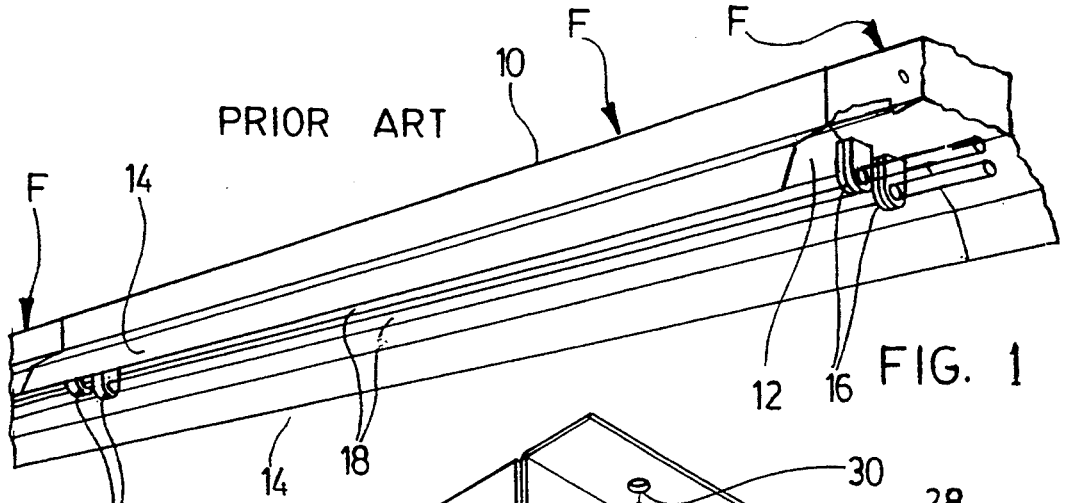
FIG. 1 is a perspective illustration of a typical longer old technology lighting fixture of the prior art, to which the invention relates in this case an eight foot fixture, and is labelled PRIOR ART.

Referring first of all to FIG. 1, it will be seen that typical old technology lighting fixtures F are there illustrated in this case. Each such fixture comprises a generally rectangular box structure 10, having a downwardly facing planar ballast cover panel 12, and reflectors 14—14 on either side thereof. Two pairs of electrical lamp sockets 16—16 are shown at opposite ends of the planar panel 12. As will be understood by those knowledgeable in the art, such lamp sockets will be spaced apart so as to receive in their typical case, an eight foot tubular lighting source. Two such lighting tubes are illustrated as 18—18.

A ballast (not shown) will typically be mounted in the box-like structure 10, and will be electrically connected by suitable wiring to the lamp sockets, so as to supply the appropriate electrical power and voltage to the tubes.

In the example illustrated the old fixtures are shown by way of example as eight foot tube fixtures. Fixtures were also made, and used for tubes of varying lengths.

The new technology tubes are shown, by way of example as four foot tubes. However, this is without limitation. A five foot tube old fixture could be retrofitted with new technology tubes of two and three foot lengths respectively and so on. (see below)

As has been explained above, the typical eight foot tubes shown by way of example in this type of lighting fixture, have a single connecting pin at each end (not illustrated) and the lamp sockets are adapted to receive such single pin connectors.

As explained above, the invention is directed specifically to the retrofitting of old technology lighting fixtures, such as that illustrated in FIG. 1, so that they may accept the high technology shorter two pin lighting tubes of the newer more efficient design, and also to the retrofitting of such lighting fixtures with new high efficiency ballasts.

In the majority of cases, lighting fixtures such as those illustrated in FIG. 1, will be mounted so that they are in end-to-end abutting relation (as partially shown in FIG. 1). There may be a very large number of such lighting fixtures arranged in such end-to-end abutting relation in many commercial and industrial buildings.

Figure 2:
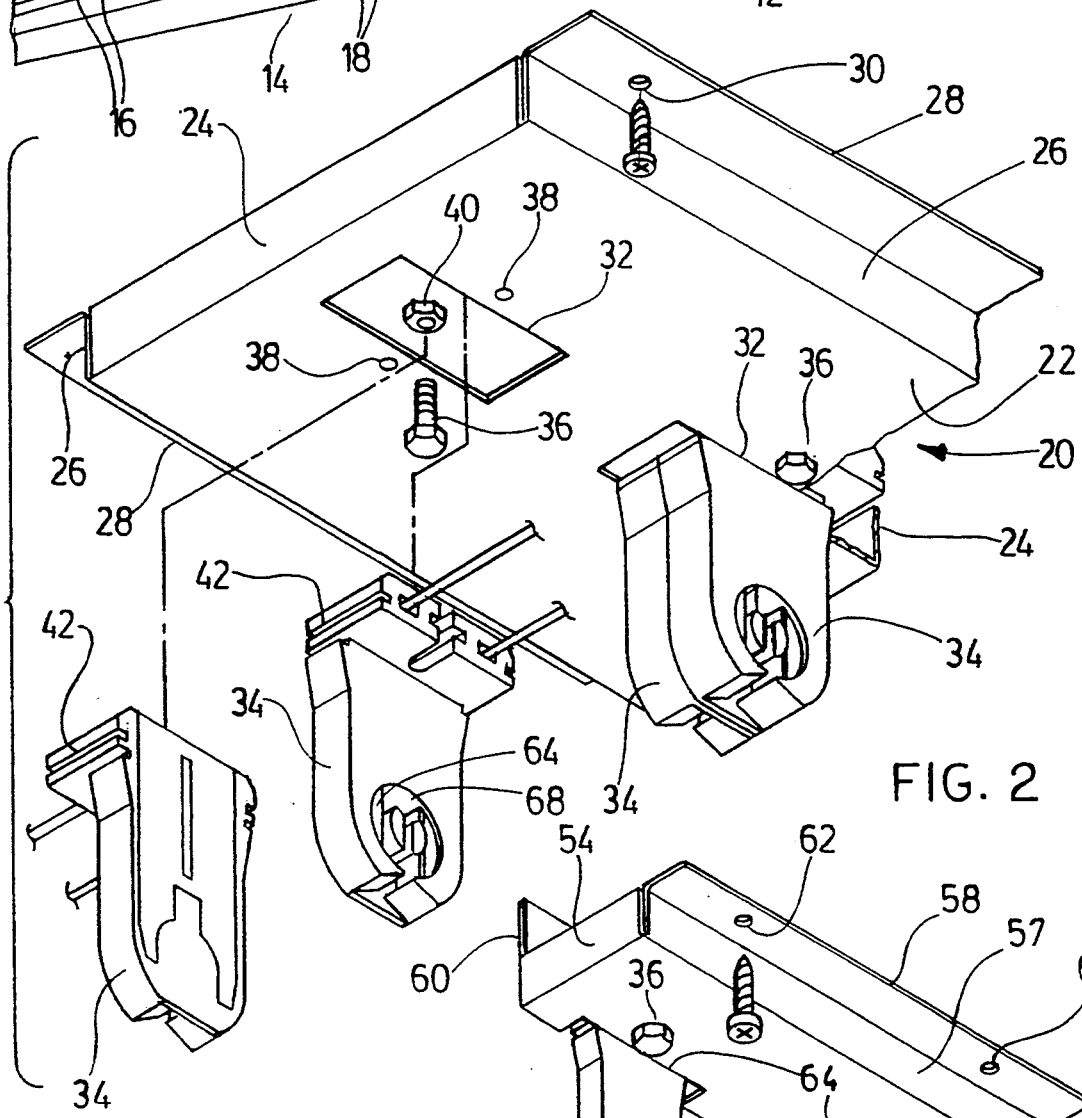
FIG. 2 is a perspective illustration of a first form of retrofit assembly in accordance with the invention, partially exploded and cut away.
Figure 3:
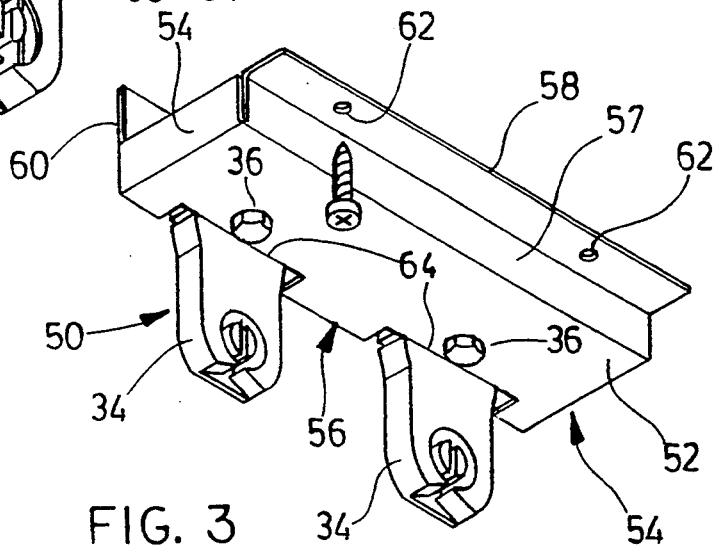
FIG. 3 is a perspective illustration of a second form of retrofit assembly.

In order to provide for the retrofitting of such lighting fixtures, with in this example, four foot long high efficiency lighting tubes, the invention provides retrofitting assemblies as illustrated in FIGS. 2 and 3.

The retrofitting assembly illustrated in FIG. 2 will be seen to comprise a two-way lamp socket adapter housing indicated generally as 20. The two-way housing 20 comprises a planar panel member 22. Along the sides of the panel member 22, side walls 24—24 are formed at an angle. Along the ends of the planar panel member 22, end walls 26—26 are formed. The side walls and end walls are formed at an angle to the planar member and form an open-sided box-like housing. In the specific example shown, the side walls and end walls are formed at right angles to panel 22. However, it will be understood that this angular relationship is not essential. Other angular relationships could be provided in certain circumstances if desired.

Attachment means are provided on the two-way housing 20. In this embodiment such attachment means comprises flanges 28—28 formed on the end walls 26—26, and adapted to lie in a common plane so as to be secured to the existing ballast cover plate 12 of an existing lighting fixture F. Screw openings 30—30 are formed in the attachment flanges 28—28, so that they may be secured to the ballast cover plate 12.

The two-way housing 20 is thus adapted to be attached to the ballast cover plate 12 of the lighting fixture F, and will enclose wiring connections (not shown) from the ballast (described below) to the new two pin electrical lamp sockets, described below.

In the FIG. 2 embodiment, the two-way housing 20 will be seen to be provided with centrally located common double lamp socket openings 32—32 for receiving the new two-pin type electrical lamp sockets 34—34 for two-pin, four foot, or other length, high technology tubes. The openings 32—32 in this case each receive two such electrical lamp sockets 34, in back-to-back relation. The lamp sockets 34 are secured to the panel member 22 by means of bolts 36, passing through bolt openings 38, and respective lamp sockets 34 located therein, by means of nuts 40 which may be incorporated in the design of the lamp sockets 34 themselves, but which are shown separately for the sake of clarity.

The lamp socket openings 32 in the panel members 22 are of simple rectangular shape in plan and receive the lamp sockets 34. Ridges 42—42 on the sides of the lamp sockets, engage the underside of panel members 22 so as to hold them in position.

Figures 7, 8, 9, 10:
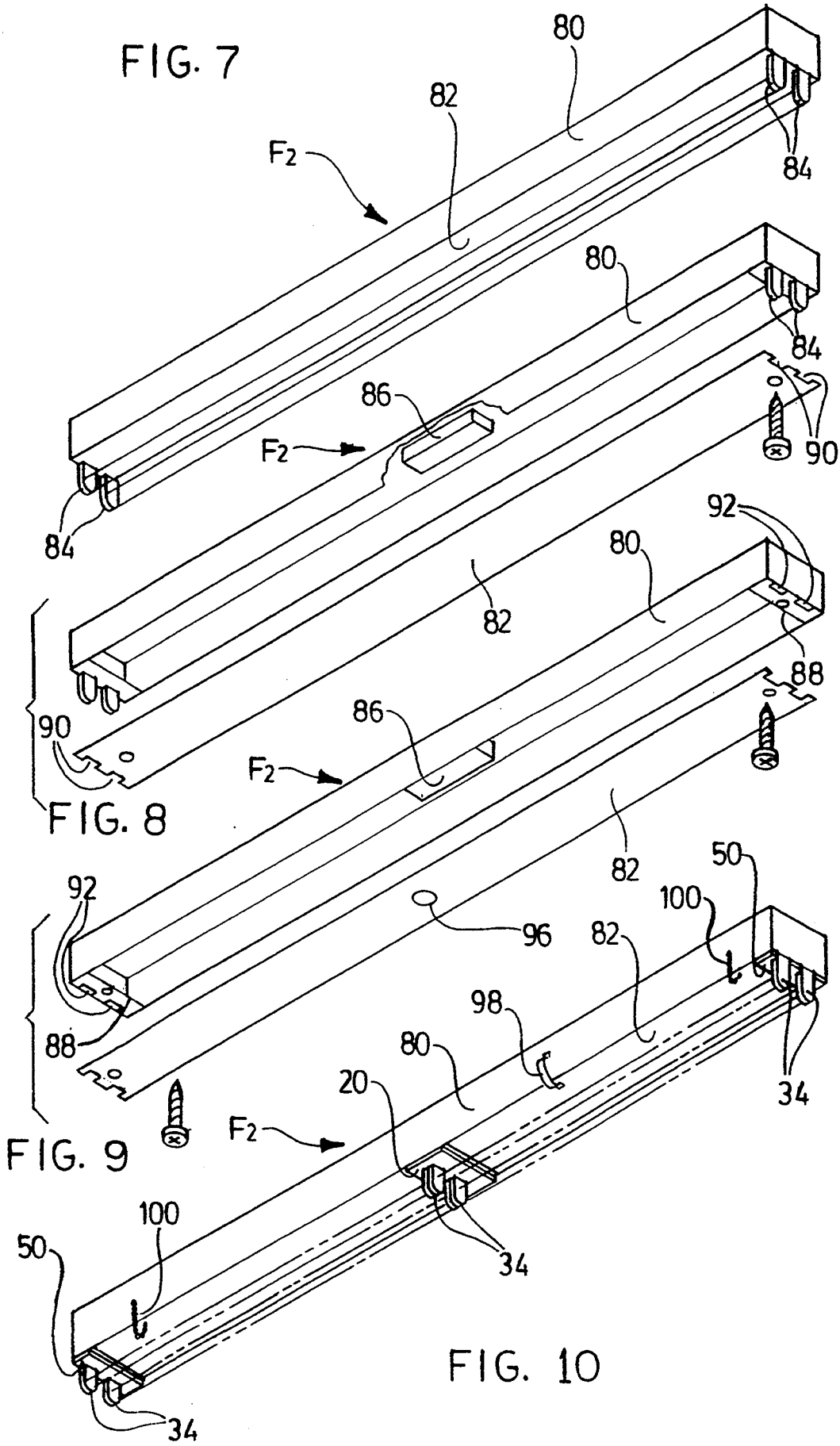
FIG. 7 is a perspective illustration of a second form of lighting fixture, prior to retrofitting.
FIG. 8 is a perspective illustration partially exploded, showing a first stage in the retrofitting operation of the fixture of FIG. 7.
FIG. 9 is a perspective illustration showing a second stage in the retrofitting operation.
FIG. 10 is a perspective illustration showing the final stage in the retrofitting operation of the fixture in FIG. 7.

It will further be seen from FIG. 2, and from the FIGS. 6 and 7, that the housing 20 in FIG. 2, are adapted to be located intermediately on the existing ballast cover plates, depending on length on the new tubes, between the ends of each electrical fixture F. In addition, further housings 20 are adapted to be located at each end of each of the electrical fixtures F, where such electrical fixtures F are located in end-to-end abutting relation. When such electrical fixtures F are mounted in this end-to-end abutting relation, the housings 20 will overlap the two adjacent ends of two adjacent fixtures F, and will be secured to the plates existing ballast cover 12 of two adjacent fixtures F, in such a manner that the new electrical lamp sockets 34 are located at the ends of the adjacent fixtures F, in essentially the same location as the original electrical lamp sockets in the adjacent fixtures F, which sockets have been removed in the retrofitting operation.

Referring to FIG. 3, a complimentary form of retrofitting assembly is shown, comprising a one-way adapter housing indicated by the general reference arrow 50.

This one-way adapter housing is designed for use at one end of a fixture F, where it does not abut with another fixture F. Housing 50 will be seen to comprise a planar panel portion 52, having side walls 54 and end walls 56, and front flange 57. Attachment means are provided, such as by means of the attachment flanges 58, and 60. Screw openings 62 are formed in the flanges 58–60 whereby the one-way housings 50 may be secured at opposite ends of a fixture F.

One or more lamp socket openings 64–64 (in this case two such openings) are formed in the panel 52 adjacent end wall 56, for receiving (in this case) new two of the two pin type lamp sockets 34—34 therein. The lamp sockets are secured as before by means such as bolts 36 and nuts 40 (not shown in FIG. 3).

By means of the one-way retrofit housing 50, individual fixtures F, which are not connected end-to-end, or a fixture F at the end of an extended run of end-to-end fixtures F, can be retrofitted with a one-way housing 50.

The two-way housings 20, and the one-way housings 50, are of sufficient dimensions, such that electrical connections of a conventional type, can be located within the respective housings 20 and 50.

Although it is believed to be well known in the art, the lamp sockets 34, of the two-pin tube type, will be seen to have two metallic electrical contacts 64—64 (FIG. 2), which are generally formed of resilient metal. As is well known in the art, the two pins of the typical four foot tube can be inserted into the recess 68 of the lamp socket 34 and then rotated through 90 degrees so as to engage the two contacts 64—64.

It will thus be seen by the use of the two-way housings 20 and the one-way housings 50, conventional old type lighting fixtures F, which may be either mounted end for end or which may be mounted individually with spaces between them, can be retrofitted to accommodate new two pin high technology tubes.

In practice, there are essentially two different types of fixtures, which are hereinafter designated as F1 and F2.

Figure 4:
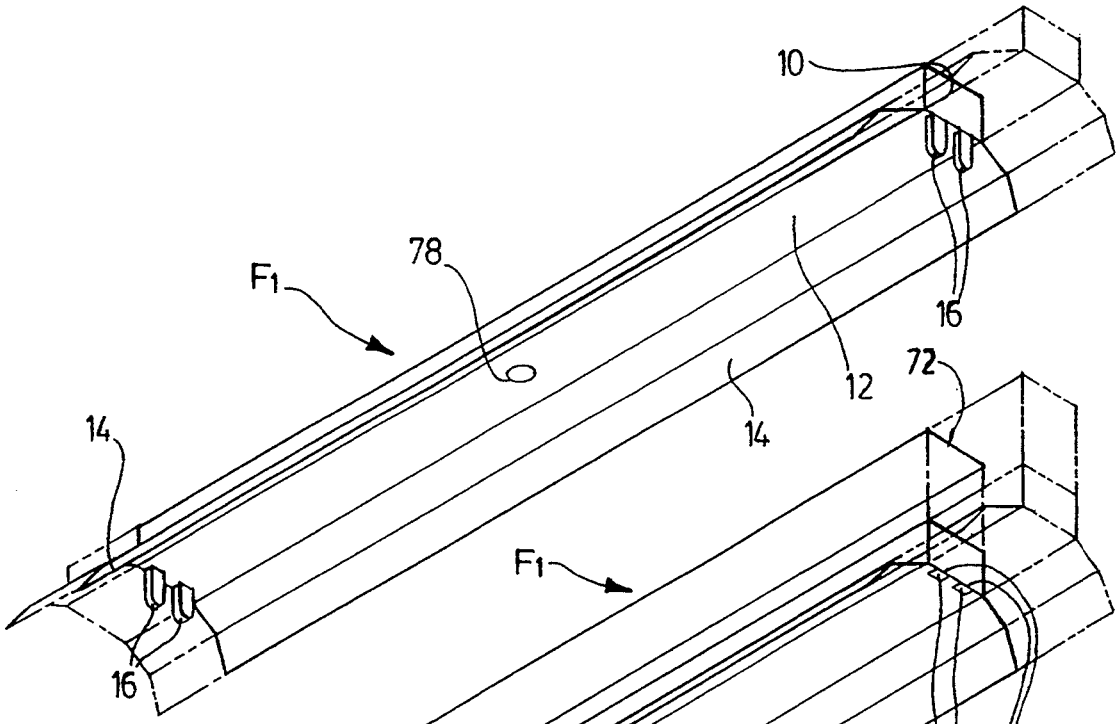
FIG. 4 is a perspective illustration of a lighting fixture of FIG. 1, shown at a first stage in the retrofit operation.
Figure 5:
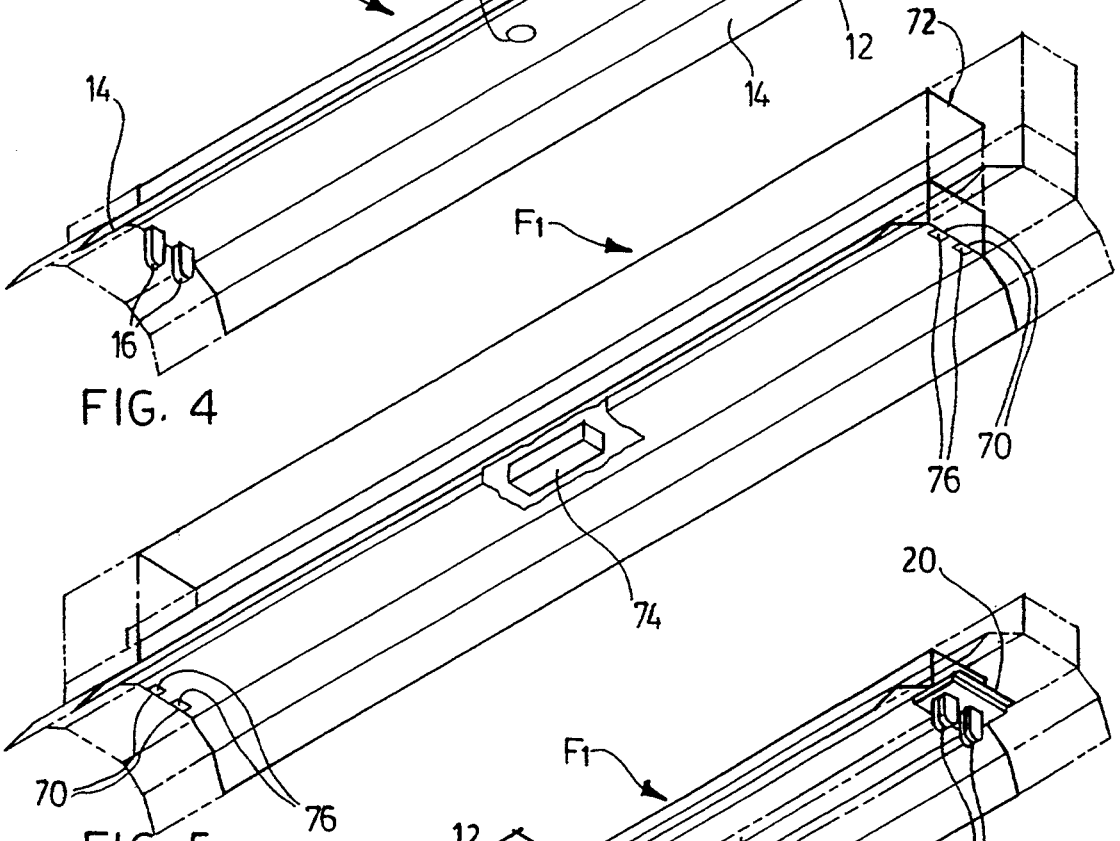
FIG. 5 is a perspective illustration corresponding to FIG. 4, showing the lighting fixture in a second stage of the operation.

The first type of fixture F1, is the reflector type of fixture, the retrofitting of which is illustrated in FIGS. 4, 5 and 6.

The second type of fixture herein designated as F2, is illustrated in its retrofitting operations in FIGS. 7, 8, 9 and 10.

Referring now to FIGS. 4, 5 and 6, the type of fixture F1 will be seen to correspond to the fixture F illustrated in FIG. 1.

The retrofitting of the typical reflector type fitting F1 is best described as follows.

In FIG. 4, the reflector type fitting F1 is illustrated, with its two tubes 18—18 (FIG. 1) having been removed from the lamp sockets 16—16. This will leave opening 70—70 (FIG. 5) at opposite ends of the ballast cover plate 12.

The box structure 10 in this type of usually has a fixed ballast cover plate 12 and fixture is usually upwardly accessible and a top panel indicated as 72 may be removed and raised upwardly as illustrated in FIG. 5.

The old ballast (not shown in FIG. 4) is then removed from within the box structure 10, and a new high technology ballast 74 is then inserted in place. Wiring from the ballast 74 is then led through the openings 70—70 previously occupied by the electrical lamp socket 16—16, such wiring being indicated as 76.

Assuming such electrical fixtures F1 as being arranged in end to end abutting relation, as is usually the case, in industrial and commercial locations then two-way housings 20—20—20 will be secured to the fixtures F1. One of the two-way housings 20 will be located on ballast cover plate 12 intermediate the two ends of each electrical fixture F1 and the other two housings 20 will be located at opposite ends of the housing F1, spanning the adjacent ends of two existing ballast cover plates and overlapping the next adjacent electrical fixtures F1, at each end.

Wiring openings 78 (FIGS. 4 and 12) will have been formed in existing the ballast cover plate 12 intermediate the two ends of fixture F1, in registration with the location of the intermediate two-way housing 20.

The electrical lamp sockets 34 on the respective housings 20—20—20 will be connected to the wiring from the new ballast 74. The housings 20—20—20 will then be secured to the ballast cover plate member 12, by screws passing through the openings 30 and the flanges 28.

As already explained above, the two-way housings 20 are designed for intermediate location on the fixtures, or to overlap the two ends of two end abutting fixtures F1, if required, so that the overlapping end two-way housings 20 can support two or four electrical lamp sockets 34, as desired, in back to back relation.

The intermediate two-way housing 20 (FIG. 6) is located intermediate the two ends of the housing F1 and again supports two, or four back to back electrical lamp sockets.

The end-most fixtures will use one-way housings 50 at their free ends.

In the final stage of the operation, two or more, four foot (or less) high technology tubes, indicated in phantom as 71 in FIG. 6 are then inserted into the new two-pin lamp sockets 34.

The retrofitted fixture F1 will then be supporting either two, or four, or more four foot (or less), high technology tubes in place of the old one or two old technology eight foot tubes (in a typical case).

The retrofitted fixture F1 of FIG. 6 will then be providing almost as much light output as the old fixture F1 of FIG. 4, but with a dramatically reduced power consumption.

In addition the high technology tubes have a colour rating higher than for old tubes. Consequently person will see as well as before, and often better than before.

FIGS. 7, 8, 9 and 10 illustrate the retrofitting of an alternate form of lighting fixture F2 which is in common use.

This type of lighting fixture F2 is not provided with reflectors. Typically, such utility type lighting fixtures are used in utility rooms, garages, passageways and the like, where lower lighting levels are acceptable.

In addition, such utility type fixtures F2 are in many cases adapted to be secured directly to the undersurface of a floor or ceiling. In many of these utility type applications, a lower level of lighting is acceptable. Consequently, it is common for such utility type fixtures F2 to be mounted in isolation, at spaced intervals from one another, and not to be mounted end for end.

Usually, such utility type lighting fixtures F2 are made in a somewhat different way from the reflector type lighting fixtures F1. As illustrated in FIG. 7, this type of utility lighting fixture F2 comprises a generally rectangular box 80, having a lower removable ballast cover plate 82. Two, four or more electrical lamp sockets 84—84 are provided at opposite ends of the box 80. In the cases of FIG. 1 and also FIG. 4 and FIG. 7, two such eight foot tubes are shown on each fixture, but in some cases only one such eight foot tube is provided, and this will depend upon the lighting requirements of the particular application.

In order to retrofit this type of fixture F2, the first step, illustrated in FIG. 8, comprises the removal of the ballast cover plate 82, and the replacement of the old ballast with a new high technology ballast 86.

The next step comprises the removal of the old single pin lamp sockets 84, as illustrated in FIG. 9. Typically, this type of fixture will incorporate end plates 88—88 at each end of the box 80. The removable ballast cover plate 82 in this type of fixture is provided with end recesses 90—90, adapted to fit around the lamp sockets 84—84.

The end plates 88—88 are provided with lamp socket openings 92—92, in which the old lamp sockets 84 were mounted.

In addition, the ballast cover plate 82 also defines recesses 90—90 referred to above, which were adapted to fit around the lamp sockets 84—84 when the ballast cover plate 82 was secured in position.

The wiring from the new ballast 86 is then led through each of the openings 92—92, and new openings 96—96 are formed in the ballast cover plate 82 for leading intermediate wiring from the ballast 86.

The ballast cover plate 82 is then replaced in position on the box 80.

New two-pin lamp sockets are then fitted in openings in the housings 20 and 50 as before, and the wiring is connected to the lamp sockets.

The retrofitting is completed by the attachment of a two-way intermediate housing 20 (FIG. 10) and the attachment of two end of the ballast cover plate 82 housings 50—50 at either end of the box 80.

The intermediate two-way housing 20 carries two, or four back to back two-pin lamp sockets, and the end housings 50—50 carry one or two or more two-pin lamp sockets as described above.

In this way, the fixture 80 is adapted to carry either two, or four, four foot high technology tubes in place of the original one, or two eight foot tubes (in a typical case).

It will be appreciated from this description that in this embodiment, the two-way housing 20 and the one-way end housings 50—50 are attached directly to the removable ballast cover plate member 82.

In order to provide for electrical integrity between the components, an electrical connection strap 98 is provided connecting between the ballast cover plate 82 and the box 80.

In addition, in order to permit servicing of the unit to replace a ballast and the like, a pair of chains 100—100 are provided at each end connected between the box 80 and the ballast cover plate 82.

Consequently, if maintenance personnel wish to release the ballast cover plate 82 from the box 80, the ballast cover plate 82 will remain both electrically connected to and also physically supported by the box 80, and will not fall to the ground.

This will permit such service personnel to do whatever work is required, for example, replacing the ballast 86 if this should fail.

Referring to FIGS. 11*a*, 11*b*, and 11*c*, it will be seen that FIG. 11*a* represents a five foot F1 fixture, formerly having two five foot tubes. It has been retrofitted in the manner described above, with T2—T2 and T3—T3 high technology tubes, two of which are two foot tubes and two of which are three foot tubes. Otherwise the apparatus and the procedure is essentially the same as that described above.

FIG. 11*b* shows a six foot old type fixture F2 which has been retrofitted in this case with four high technology type tubes T3—T3 T3—T3 of three foot size. Otherwise the retrofitting equipment and the steps are essentially the same as that described above.

FIG. 11*c* represents an old type seven foot fixture F3. This fixture has been retrofitted with two three foot high technology tubes T3—T3 and two four foot high technology tubes T4—T4. Otherwise the retrofitting equipment and the method are essentially the same as that described above. Wherever the words "ballast cover plate" are used they are intended to refer either to the removable lower cover plate, in one type of fixture, or the lower plate of the fixture box, in other types of fixture.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A retrofitting apparatus for retrofitting existing lighting tube lighting fixtures having tubes of a predetermined length comprising;

at least one two way lamp socket adapter housing of generally open side box shape;

at least one common double lamp socket opening in said two way housing;

two electrical lamp socket means supported on said two way housing in each said double lamp socket opening, facing in opposite directions;

means for attaching said two way adapter housing to the exterior of an existing ballast cover plate of an existing fixture;

at least one one-way lamp socket adapter housing adapted to be located at least one end of said existing ballast cover plate of a said lighting fixture, and comprising a generally open sided box like configuration defining an end edge;

at least one single lamp socket opening therein adjacent said end edge;

one electrical lamp socket extending through each said one-way lamp socket opening, and, fastening means for securing said one way lamp socket adapter housing to the exterior of said existing ballast cover plate of said electrical fixture, at one end thereof.

2. A retrofitting apparatus as claimed in claim 1 and wherein said two way lamp socket adapter housing includes a generally planar plate member, and two side walls formed at an angle thereto, and two end walls formed at an angle thereto, defining a generally rectangular open sided housing, and attachment flange means on at least one of said end walls or said side walls, attachment opening means formed in said attachment flange means, and fastening-openings formed in said plate member, adjacent said double lamp socket opening therein, for securing said two electrical lamp sockets therein.

3. A retrofitting apparatus as claimed in claim 1 and wherein said one-way adapter housing comprises a generally planar plate member, and side walls formed at an angle thereto, and an end wall formed at one end at an angle thereto and a front flange formed at an angle thereto at a front end to form an open-sided box-like housing, and at least one attachment flange means extending from at least one of said side walls and said end wall of said front flange, attachment opening means formed in said attachment flange means, and fastening opening means formed in said planar member adjacent said at least one single lamp socket opening, for securing at least one lamp socket therein.

4. An electrical lighting fixture of the type having a box, for a ballast and wiring, and a ballast cover plate, and designed for supporting a long tube or tubes of a predetermined length, and adapted to support two or more shorter lighting tubes having a combined length substantially equal to the length of said long tube, or tubes, and comprising;

a generally rectangular box shaped lighting fixture;

ballast means within said box shaped fixture connected to a source of electrical power, said rectangular box shaped fixture having a generally planar ballast cover plate secured thereto;

end lamp socket adapter housing means at each end of said ballast cover plate secured to the exterior thereof;

intermediate lamp socket adapter housing means located intermediate said ends of said ballast cover plate secured to the exterior thereof;

end opening means formed in each end of said ballast cover plate in registration with said end housing means:

intermediate opening means formed in said ballast cover plate in registration with said intermediate housing means;

electrical lamp sockets mounted on said housing means, oriented to receive at least two electrical lighting tubes, arranged end to end, said lighting tubes extending from each said end housing means on said ballast cover plate, to said intermediate housing means, whereby said electrical lighting fixture thereby supports said at least two lighting tubes thereon in end to end configuration said at least two tubes having a combined length substantially equal to the length of said longer tube, and, electrical connection means extending from said ballast means, through said opening means in said ballast cover plate, to said lamp sockets mounted on said end and intermediate housing means.

5. An electrical lighting fixture as claimed in claim 4 and wherein said housing means comprise generally rectangular box structures secured to said ballast cover plate.

6. A plurality of electrical lighting fixtures for electrical lighting tubes of the type having a box, for a ballast and wiring, and a ballast cover plate, and receptacles for supporting a long tube or tubes of a predetermined length and comprising;

a series of said fixtures mounted in end-to-end abutting relation;

a two way lamp socket adapter housing extending between two ballast cover plates of two adjacent ends of two said lighting fixtures and secured to the exteriors of both said ballast cover plates;

an intermediate two way lamp socket adapter housing mounted on each said ballast cover plate intermediate said ends, secured to the exterior thereof and, electrical lamp sockets for receiving said tubes mounted on said two way housing means, arranged in back-to-back relation, for receiving at least two shorter tubes in end to end relation having a combined length substantially equal to said long tube.

7. A plurality of electrical fixtures as claimed in claim 6 and including one way housing means at at least one end of at least one said electrical fixture, and at least one electrical lamp socket supported on said one way housing means.

8. A method of retrofitting an existing electrical lighting fixture for electrical lighting tubes, of the type having a box for a ballast, and wiring, and a ballast cover plate, said lighting fixture defining two ends, and existing electrical lamp sockets mounted at said two ends and extending through openings in said ballast cover plate for receiving at least one long lighting tube extending therebetween, and comprising the steps of;

removing said at least one long lighting tube;

removing said existing electrical lamp sockets from either end of said lighting fixture;

securing a lamp socket adapter housing to the exterior of said ballast cover plate over said openings at each end of said ballast cover plate of said electrical fixture;

forming an intermediate opening in said ballast cover plate;

securing a further lamp socket adapter housings intermediate said two ends of said lighting fixture, to exterior of said ballast cover plate over said intermediate opening said lamp socket housing means supporting new electrical lamp sockets for receiving new shorter tubes therebetween;

connecting said new electrical lamp sockets to a source of electrical power, and, mounting at least one new shorter electrical lighting tube between said lamp socket housing means at one said end and said further lamp socket housing means, and;

mounting at least one new further shorter lighting tube between said lamp socket housing means at said other end and said further lamp socket housing means, whereby said new shorter lighting tubes are mounted on said electrical fixture in end-to-end relation and have a combined length substantially equal to the length of said long tube.

9. A method as claimed in claim 8 and wherein said electrical lighting fixture includes box means, and ballast means therein, and including the step of opening said box means, removing said ballast means, and replacing the same with further ballast means, and connecting said further ballast means to said electrical lamp sockets on said housing means.

* * * * *

UNITED STATES PATENT AND TRADEMARK OFFICE

CERTIFICATE OF CORRECTION

PATENT NO. : 5,371,661

DATED : December 6, 1994

INVENTOR(S) : Alexander L. Simpson

It is certified that error appears in the above-indentified patent and that said Letters Patent is hereby corrected as shown below:

Claim 1 (Col.10) line 6
after "single" insert -- one-way --

Claim 3 (Col.10) line 37
after "single" insert -- one-way --

Claim 8 (Col.12) line 14
delete "housings" and insert -- housing --

Claim 8 (Col.12) line 15
after "to" insert -- the --

Signed and Sealed this

Nineteenth Day of December, 1995

*Attest:*

*Attesting Officer*

BRUCE LEHMAN

*Commissioner of Patents and Trademarks*